United States Patent [19]

Ricles et al.

[11] Patent Number: 4,886,127

[45] Date of Patent: Dec. 12, 1989

[54] APPARATUS FOR FIRING BOREHOLE PERFORATING APPARATUS

[75] Inventors: Thomas D. Ricles, Kingwood; Gary R. Domstead, Angleton, both of Tex.

[73] Assignee: Dresser Industries, Inc., Dallas, Tex.

[21] Appl. No.: 275,300

[22] Filed: Nov. 23, 1988

[51] Int. Cl.[4] ..... E21B 43/11

[52] U.S. Cl. ..... 175/4.54; 175/4.56; 166/55; 403/3

[58] Field of Search ..... 166/297, 55, 55.1, 55.2, 166/374; 175/4.54, 4.56; 285/3; 403/3

[56] References Cited

U.S. PATENT DOCUMENTS

| | | | |
|---|---|---|---|
| 2,304,408 | 12/1942 | Holifield | 175/4.56 |
| 3,091,293 | 5/1963 | Fry | 166/123 |
| 3,344,861 | 10/1967 | Claycomb | 166/123 |
| 3,800,705 | 4/1974 | Tamplen | 175/4.54 |
| 4,484,639 | 11/1984 | Ayers | 166/297 |
| 4,509,604 | 4/1985 | Upchurch | 166/297 |
| 4,523,643 | 6/1985 | McGlothen | 166/297 |
| 4,526,233 | 7/1985 | Stout | 175/4.56 |
| 4,554,981 | 11/1985 | Davies | 175/4.56 |
| 4,606,409 | 8/1986 | Peterson et al. | 166/297 |
| 4,610,312 | 9/1986 | Nelson et al. | 175/4.54 |
| 4,616,718 | 10/1986 | Gambertoglio | 106/297 |
| 4,690,227 | 9/1987 | George et al. | 175/4.54 |
| 4,762,179 | 8/1988 | Wesson et al. | 166/297 |
| 4,770,246 | 9/1988 | Ward | 166/297 |

*Primary Examiner*—Bruce M. Kisliuk

[57] ABSTRACT

In a preferred embodiment of the invention, a pressure actuated firing assembly for use in connection with a tubing conveyed perforating system is provided. The firing assembly is connected to a cable and lowered into engagement with the tubing conveyed perforating apparatus set within the well. The cable is removed and pressure is applied to the tubing annulus. At a predetermined pressure a shear member breaks, arming the firing assembly. Force is exerted upon an impact firing rod by a spring member causing fluid to move from a reservoir through a flow path traversing a piston attached to the impact firing rod. In one embodiment, the flow path may be restricted to provide a time delay before the impact firing rod is released whereby the force exerted by a spring forces the firing rod into a percussion firing assembly to thereby detonate the percussion firing assembly and the attached perforating apparatus. Alternatively no flow path may be provided to give instantaneous firing. Unloading members in the form of collets on the piston, prevent the spring's stored energy from being applied to the shear member. Additionally, a keeper key is inserted to prevent relative rotation of the shear member and the torsional forces which may accompany such rotation.

15 Claims, 2 Drawing Sheets

APPARATUS FOR FIRING BOREHOLE PERFORATING APPARATUS

BACKGROUND OF THE INVENTION invention relates generally to subsurface well apparatus, more specifically, to apparatus for perforating subsurface earth formations, and particularly to pressure actuated apparatus for firing tubing conveyed perforating apparatus.

It has become common practice in the completion of oil and gas wells to perforate the well casings and the surrounding formations to bring a well into completion. One method of providing this capability has a perforating apparatus attached to the end of a tubing string which is lowered and set in place when the perforating apparatus is opposite the formation to be produced. The perforating apparatus may then be detonated and the well placed into production through the tubing string. One example of a tubing conveyed perforating apparatus can be found in U.S Pat. No. 4,523,643, issued to J. R. McGlothen, and assigned to the assignee of the present invention, which is incorporated by reference.

The systems for firing the perforating devices have typically been either an electrical firing system or a nonelectrical percussion firing system activated by dropping a member through the tubing. Neither method has been entirely satisfactory in the past. Electrical firing systems require care in connecting and running and can be activated from stray electrical currents. In addition, electrical connections can be short-circuited by moisture. Percussion firing systems commonly require a bar, referred to as a "go devil", be dropped through the tubing string thereby impacting a percussion firing assembly. These percussion firing assemblies typically have some primary explosives in the perforating apparatus while it is affixed to the tubing string and lowered into position within the well. As a result of the deficiencies of these systems, accidental and premature firings are a possibility. In addition, in a highly deviated well the bar member may not reach the perforating gun.

In an effort to overcome some of the deficiencies of the electrical and bar firing systems, various pressure responsive firing systems have been developed. In one typical embodiment and increased pressure is applied through the tubing string to the pressure responsive firing assembly. The increased pressure forces a firing pin into contact with an explosive detonator, thereby firing the perforating device. One such system is illustrated in U.S. Pat. No. 2,304,408, issued to A. J. Holifield. Systems of this type are unsatisfactory where the perforating operation is to be conducted under conditions of pressure "underbalance", where the borehole pressure is less than formation fluid pressure. Such underbalance perforating operations have become common in the area of tubing conveyed perforating.

In an effort to overcome this last deficiency a perforating firing apparatus has been developed wherein the fluid pressure in the tubing is directed into the firing apparatus where it works against a piston which shears a shear member releasing a spring loaded firing pin. This system is exemplified in U.S. Pat. No. 4,770,246 which is also commonly assigned to the assignee of the present invention and which is also incorporated herein by reference. One problem encountered in the system disclosed therein is that the shear member is subjected to the stored energy in the spring. Additionally the shear member may be accidentally rotated during assembly, prematurely releasing the firing pin. Concomitantly, the shear member must always have a tensile strength greater than the stored energy in the spring requiring higher internal pressures to break the member.

These and other disadvantages are overcome with the present invention by providing an apparatus for firing subsurface perforating apparatus using a pressure actuated firing system for use in underbalanced pressure conditions which protects the shear member from both tension and torsion forces.

SUMMARY OF THE INVENTION

In a preferred embodiment of the invention, a pressure actuated firing assembly for use in connection with a tubing conveyed perforating system is provided. The firing assembly is connected to a cable and lowered into engagement with the tubing conveyed perforating apparatus set within the well. The cable is removed and pressure is applied to the tubing annulus. At a predetermined pressure a shear member breaks, arming the firing assembly. Force is exerted upon an impact firing rod by a spring member causing fluid to move from a reservoir through a flow path traversing a piston attached to the impact firing rod. In one embodiment, the flow path may be restricted to provide a time delay before the impact firing rod is released whereby the force exerted by a spring forces the firing rod into a percussion firing assembly to thereby detonate the percussion firing assembly and the attached perforating apparatus. Alternatively no flow path may be provided to give instantaneous firing. Unloading members in the form of collets on the piston, prevent the spring's stored energy from being applied to the shear member. Additionally, a keeper key is inserted to prevent relative rotation of the shear member and the torsional forces which may accompany such rotation.

DETAILED DESCRIPTION OF A PREFERRED EMBODIMENT

Figure 1A:
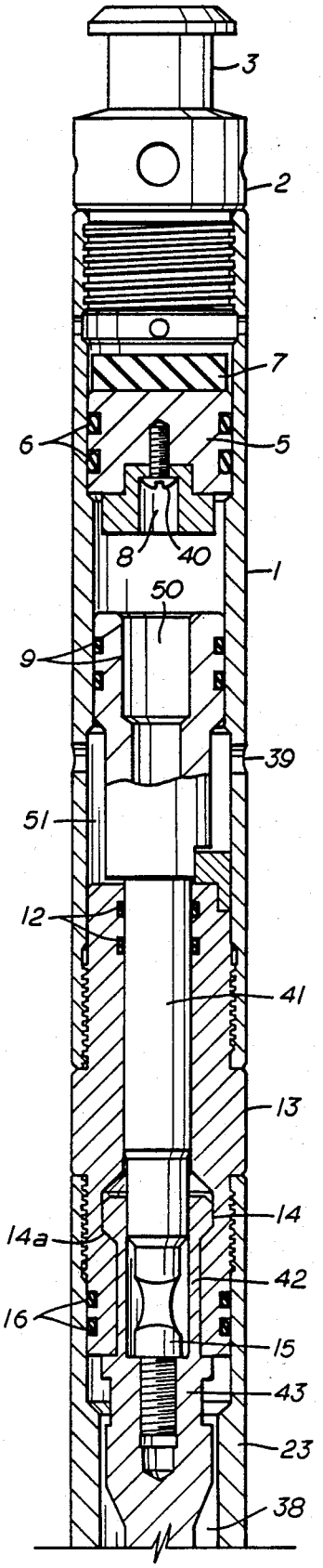
FIGS. 1–1C are a longitudinal view, partly in crossection of one embodiment of the pressure actuated firing apparatus of the present invention.
Figure 1B:
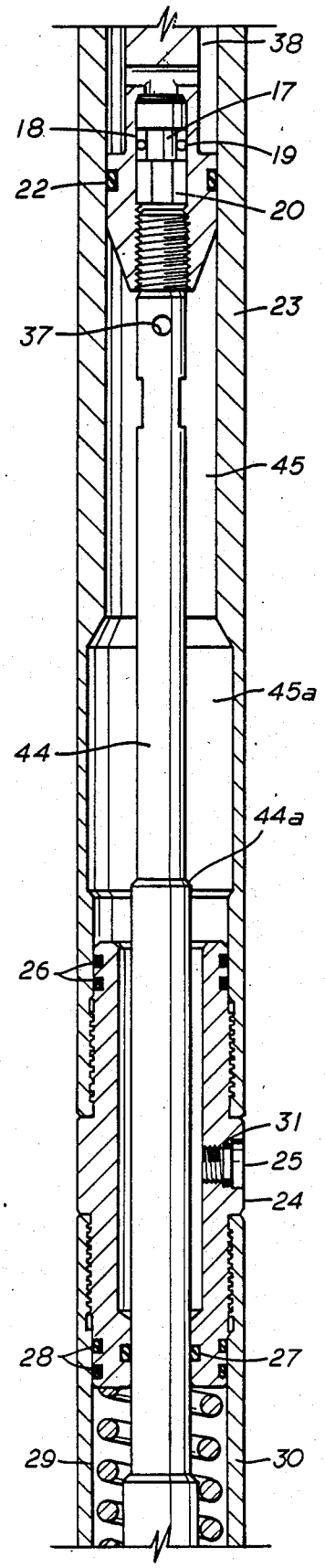
Figure 1C:
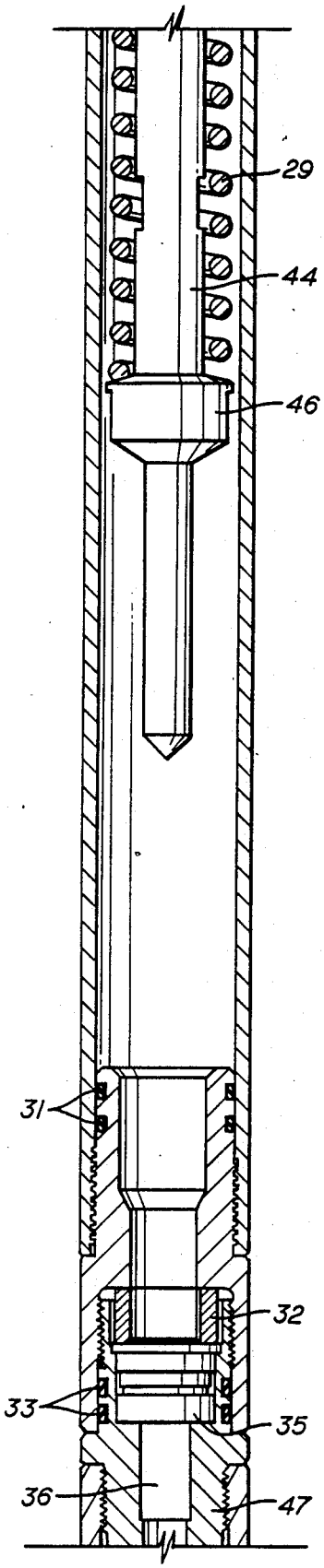

Referring now to FIGS. 1A–1C, therein is illustrated a section view of the firing apparatus in accordance with the present invention. The firing apparatus includes connector 3, commonly referred to as a fishing neck sub. Connector sub 3 has a first portion adapted for connection to a fishing tool in a manner common in the art, and is threadably attached to a first end of housing section 1. Coupled to connector sub 3, inside of housing section 1, is damper pad 7. Damping piston 5 is coupled to damper pad 7. Retained by screw 40 to damping piston 5 is impact pad 8. Impact pad 8 and damper pad 7 are made of suitable shock absorbing material such as rubber. Preferably impact pad 8 is made of an elastomer having a 60-70 durometer hardness. Seal members 6 provide a fluid seal between damping piston 5 and housing section 1.

The second end of housing section 1 is threadably connected to a coupling sub member 13, having a central longitudinal bore therethrough and having an enlarged cavity portion in one end thereof. Piston member 10 has a first portion having an outer diameter slightly smaller than the inner diameter of housing section 1 and a second portion sized to fit within the cavity portion of coupling sub member 13. Upper end of piston 10 includes open cylindrical cavity 50 which has a slightly smaller diameter than impact pad 8. The cavity 50 serves to reduce the mass of piston 10 and thus the upward momentum of the piston during arming. The lower mass of piston 10 also serves to reduce the downward momentum of piston 10 and rod 41 if the apparatus is released prematurely while lowering into the borehole. Seal members 9 provide a fluid seal between piston member 10 and housing section 1. Chamber 51 is formed within housing section 1 in the area between piston member 10 and coupling member 13. Chamber 51 is in fluid communication with the tubing annulus (not shown) by ports 39.

Connected to piston member 10 is one end of rod member 41. Rod member 41 is disposed within the central bore of coupling sub member 13, with a fluid seal therebetween provided by seal members 12. Coupled to the other end of rod member 41 is pullapart bar 15. Housing section 23 is threadably connected at one end to coupling sub member 13. Seal members 16 provide a fluid seal between coupling sub member 13 and housing section 23. Bar 15 is threadably connected to piston member 43. On the upper end of piston member 43 are load bearing members in the form of integrally formed collets 42 which are biased inward. Each of collets 42 is provided with outwardly projecting shoulders 14 which rest on inwardly projecting shoulders 14*a* formed in coupling sub member 13. The upper ends of inwardly biased collets 42 are prevented from collapsing inward by rod 41. Additionally an anti-torsion member in the form of a keeper key 11 is disposed in longitudinal keyways 11*a* and 11*b* in upper end of coupling sub member 13 and piston 10 to prevent relative rotation of piston 10 with rod 41 and bar 15.

Piston member 43 has a fluid passage 17 terminating at one end in an internally threaded cavity portion. Contained within fluid passage is flow restrictor valve 18 having external seal members 19. Below flow restrictor valve 18 is a spacer 20 which may be replaced with another flow restrictor valve as 18 to further delay the downward movement of the piston.

Coupled to the second end of housing section 23 is coupling sub member 24, having a central, longitudinal bore therethrough. A port, sealed by removable plug 25, communicates through coupling sub member 24 to the longitudinal bore. Seal members 26 provide a fluid seal between coupling sub member 24 and housing section 23. The other side of coupling sub member 24 is threadably connected to housing section 30. Seal members 28 provide a fluid seal between housing section 30 and coupling sub member 24.

Disposed centrally within housing section 23, the central bore of coupling sub member 24 and housing section 30 is rod member 44. Rod member 44 is threadably connected at a first end to piston member 43. A central fluid passage in a portion of rod member 44 communicates through port 37 to fluid passage 17 in piston member 43. Seal member 27 provides a dynamic fluid seal between rod member 44 and coupling sub member 24. It should be noted that a reservoir 45 for retaining a fluid, such as oil, is formed in the central bore of coupling sub member 24 and housing section 23, below piston member 43. The reservoir 45 fluidly communicates with the reservoir 38 in housing section 23, above piston member 43, through port 37 and fluid passage 17. The reservoir 45 can be filled with such fluid through the port sealed by plug 25.

Coupled to the other end of rod member 44 is striker 46. Disposed in the internal cavity of housing section 30, about rod member 44, is spring member 29. Spring member 29 is a helical compression spring. A first terminus of spring member 29 is in contact with the face of coupling sub member 24. The second terminus of spring member 29 contacts the face of striker 46, which includes a tang portion extending therefrom.

Coupled to the end of housing section 30 is a firing head assembly as described in U.S. Pat. No. 4,770,246 and more completely described in U.S. Pat. No. 4,484,639, which is hereby incorporated herein by reference.

Figure 2:
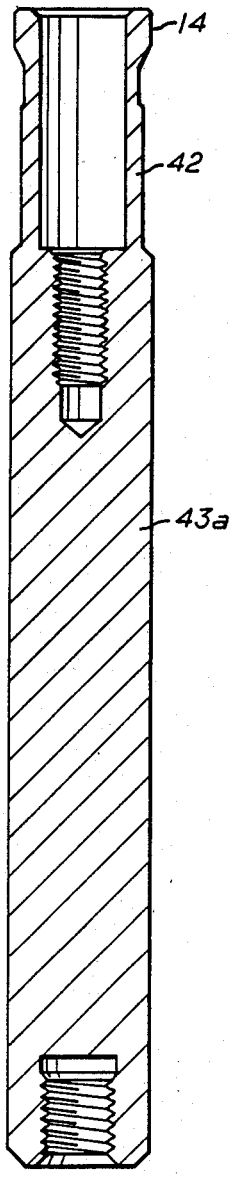
FIG. 2 is an alternative piston with no flow path when no time delay is desired.

FIG. 2 illustrates a piston which may be used in place of piston 43. The replacement piston 43*a* has no flow passageway and may be used with no oil in reservoir 46 to give an instant firing of the perforating apparatus for example when the pressure actuated firing apparatus is used in a pressure overbalanced situation.

In overall operation, the components of the tubing conveyed perforating system are assembled and lowered into the well, and packer set to isolate the zone to be perforated. The firing apparatus is connected to a cable, preferably a non-electrical slick line, at connector sub 3 by means of a fishing tool common in the art. The firing apparatus is lowered through the tubing until the firing apparatus engages a firing head by a grapple sub as described in U.S. Pat. No. 4,770,246 column 3 lines 59–66. After the firing assembly is latched onto the perforating apparatus, tension is pulled on the cable thereby causing the fishing tool to release from connector sub 3 and the cable removed from the well. The lower mass of the piston 10 prevents excessive momentum forces against tensile bar 15 if the apparatus is prematurely released in the borehole and free falls until it contacts the perforating apparatus.

To actuate the firing apparatus pressure within the tubing string is increased by means of a pump (not shown) located at the earth's surface or by gas pressure. The increase in pressure causes a corresponding increase in chamber 51 by way of port 39. When the force exerted by the pressure against piston 10 exceeds the tensile rating of pull-apart bar 15, bar 15 will shear, mechanically decoupling rod 41 from piston 43. Rod 41 will rise upward in the central bore of coupling sub member 13 allowing inwardly biased collets 14 to collapse arming the firing apparatus. Piston member 10, with rod member 41 attached thereto, will be driven by the pressure within chamber 51 through housing section 1 into contact with impact pad 8 which will "cold flow" into cavity 50. Therefore, when bar 15 shears and piston member 10 impacts impact pad the impact is dampened without damage to the housing in connector sub 3. Impact pad 8 and thus possible damper pad 7 prevent metal to metal contact and damage to piston member 10 and damping piston 5. In the preferred embodiment bar 15 is selected in view of well conditions.

In order to perforate the formations in an underbalanced pressure condition, once the firing apparatus is armed, pressure is released from the tubing string or annulus. To allow sufficient time delay for the pressure to be reduced the firing apparatus is provided with a preselected time delay between arming and firing. Once armed the force exerted on rod member 44 and thus piston 43 will force fluid from the reservoir 45 within housing section 23 through port 37 and fluid passage 17 to reservoir 38 on the other side of piston member 43. Flow restrictor valve or valves 18 provide a restriction to the fluid migration from reservoir 45 to reservoir 38, thereby restricting the longitudinal travel of piston 43 and rod member 44. Flow valve or valves 18 or fluid viscosity can be selected to provide a number of time delays. In the preferred embodiment delays of eight, fifteen, twenty-five and thirty-five minutes up to six hours can be selected by changing of flow valve 18 or fluid viscosity.

As fluid is displaced from reservoir 45 to reservoir 38 through flow valve 18, piston member 43 will continue to move slowly downwardly within housing section 23 until seal member 22 on piston 43 enters the enlarged diameter section 45*a* of housing section 23 and the reduced diameter portion 44*a* of rod 44 passes seal 27. At that point fluid is allowed to pass around seal 22 on piston member 43 and seal 27 around rod 44, reducing fluid resistance to longitudinal movement of piston 43, and spring member 29 will drive rod member 44 downward causing striker 46 to impact the percussion detonator of the perforating apparatus. A more complete description of the ignition of the firing head assembly is contained in the aforementioned U.S. Pat. No. 4,484,639.

Once the firing operation is complete, or should failure of the firing assembly occur the entire assembly can be removed and or replaced as described in the aforementioned U.S. Pat. No. 4,770,246.

Many modifications and variations besides those specifically mentioned herein may be made in the techniques and structures described herein and depicted in the accompanying drawing without departing substantially from the concept of the present invention. Accordingly, it should be clearly understood that the form described and illustrated herein is exemplary only, and is not intended as a limitation on the scope of the present invention.

What is claimed is:

1. In a pressure actuated apparatus for firing a perforating gun disposed in a tubing string within a borehole having an elongated housing and an arming means including a piston moveable in a fluid chamber and fixed to said housing by a shear member which is shearable in response to the fluid pressure within said tubing string, a striker fixed to said piston and spring biased to move in a direction for firing said perforating gun, the improvement comprising first means for protecting said shear member from any tensile force due to said spring bias.

2. The pressure actuated apparatus of claim 1 further comprising second means to prevent relative rotation of said shear member and said piston.

3. The pressure actuated apparatus of claim 2 wherein said second means comprises a longitudinal keeper key in keyways disposed in said shear member and said housing.

4. The pressure actuated apparatus of claim 1 wherein said first means comprises a plurality of collets machined in the upper end of said piston, said collets resting on shoulders in said housing and collapsible inward when said shear member shears in response to said fluid pressure.

5. Apparatus adapted to be lowered into a borehole for firing a perforating gun disposed on a tubing string, comprising:

an elongated housing member;

a first piston disposed within said housing member, said first piston being slidable in response to pressure within said tubing string;

a second piston coupled to said first piston by a shear member, said second piston being slidably disposed within said housing member, said shear member shearing and decoupling said first piston from said second piston in response to said pressure;

a rod member coupled to said second piston;

biasing means disposed about at least a portion of said rod member for exerting a force on said rod member for longitudinal movement of said rod member and said second piston in response to the decoupling of said second piston from said first piston; and a load bearing member to prevent said force from acting on said shear member.

6. The apparatus of claim 5 further comprising anti-torsion member to prevent relative rotation between said first and second pistons to prevent rotational force being applied to said shear member.

7. The apparatus of claim 6 wherein said anti-torsion member comprises a keeper key disposed in longitudinal keyways provided in said first piston and the inner wall of said housing member.

8. The apparatus of claim 5 wherein said first and second pistons are coupled by a second rod having said shear member disposed between said second rod and said second piston and said load bearing member comprises collets integral with said second piston, said collets having outwardly protruding shoulders resting on inwardly protruding shoulders within said housing, said collets being biased inward and resting against said second rod such that when said shear member separates said second rod slides longitudinally in said housing member releasing said collets inwardly away from said inwardly protruding shoulders.

9. The apparatus of claim 5 further comprising means for restricting the longitudinal movement of said rod member and said second piston for a predetermined time period after decoupling of said second piston from said first piston.

10. Apparatus adapted to be lowered into a borehole for firing a perforating gun disposed on a tubing string, comprising:

an elongated housing;

a first piston disposed within said housing member, said first piston being slidable in response to pressure within said tubing string;

a second piston coupled to said first piston by a first rod and a shear member adjacent said second piston, said second piston being slidably disposed within said housing member, said shear member shearing and decoupling said first piston from said second piston in response to said pressure;

a plurality of inwardly biased collets integral with said second piston, each of said collets resting against said first rod and having outwardly projecting shoulders, said outwardly projecting shoulders resting on inwardly projecting shoulders in said housing member;

a keeper key disposed in longitudinal keyways in said first piston and said housing member;

a second rod member coupled to said second piston; and biasing means disposed about at least a portion of said second rod member for exerting a force on said rod member for longitudinal movement of said rod member and said second piston in response to the decoupling of said second piston from said first piston.

11. The apparatus of claim 10 further comprising means for restricting the longitudinal movement of said rod member and said second piston for a predetermined time period after decoupling of said second piston from said first piston.

12. The apparatus of claim 11 wherein said restricting means further comprises at least one flow restriction valve to restrict fluid flow across said second piston.

13. The apparatus of claim 11 further comprising a cavity within the upper end of said first piston to reduce the mass of said first piston.

14. The apparatus of claim 13 wherein said housing further comprises a connector sub assembly on one end for connection to a cable; and a dampening piston disposed within said housing above said first piston to dampen the impact of said first piston when said first piston slides in response to said pressure.

15. The apparatus of claim 14 further comprising an impact pad connected to said dampening piston and adapted to be conformed to said cavity when said first piston impacts said dampening piston.

* * * * *